US005616008A

United States Patent [19]

Yokono et al.

[11] Patent Number: 5,616,008

[45] Date of Patent: Apr. 1, 1997

[54] VARIABLE DISPLACEMENT COMPRESSOR

[75] Inventors: Tomohiko Yokono; Masanori Sonobe; Masahiro Kawaguchi; Takuya Okuno; Ken Suitou, all of Kariya, Japan

[73] Assignee: Kabushiki Kaisha Toyoda Jidoshokki Seisakusho, Kariya, Japan

[21] Appl. No.: 624,002

[22] Filed: Mar. 27, 1996

[30] Foreign Application Priority Data

Mar. 30, 1995 [JP] Japan ..... 7-073667

[51] Int. Cl.[6] ..... F04B 1/28; F04B 49/00

[52] U.S. Cl. ..... 417/222.2

[58] Field of Search ..... 417/222.2, 270

[56] References Cited

U.S. PATENT DOCUMENTS

| | | | |
|---|---|---|---|
| 4,526,516 | 7/1985 | Swain | 417/270 |
| 5,094,590 | 3/1992 | Carella et al. | 417/222.2 |
| 5,173,032 | 12/1992 | Taguchi et al. | 417/222.2 |
| 5,417,552 | 5/1995 | Kayukawa et al. | 417/222.2 |
| 5,486,098 | 1/1996 | Kimura | 412/222.2 |

FOREIGN PATENT DOCUMENTS

| | | |
|---|---|---|
| 0628722 | 12/1994 | European Pat. Off. . |
| 06346845 | 12/1994 | Japan . |
| 07019165 | 1/1995 | Japan . |

*Primary Examiner*—Richard E. Gluck
*Attorney, Agent, or Firm*—Brooks Haidt Haffner & Delahunty

[57] ABSTRACT

A variable displacement compressor having a rotary shaft and a swash plate is described. The swash plate is mounted on the shaft and rotates integrally with the shaft. The swash plate tilts between a maximum inclined angle and a minimum inclined angle and is connected to a plurality of pistons. The inclined angle of the swash plate is altered by the difference between the pressure in a crank chamber and the pressure in a suction chamber. Each piston reciprocates inside a cylinder bore with a stroke determined by the inclined angle of the swash plate and compresses refrigerant gas, which includes oil mist. A spool is arranged adjacent to the swash plate on the shaft. On the shaft, a thrust bearing is provided between the swash plate and the spool, and a radial bearing is provided in the spool. The spool has an opening opposed to the swash plate. Grooves that allow the flow of refrigerant gas into the spool are formed at the opening in the walls of the spool.

16 Claims, 5 Drawing Sheets

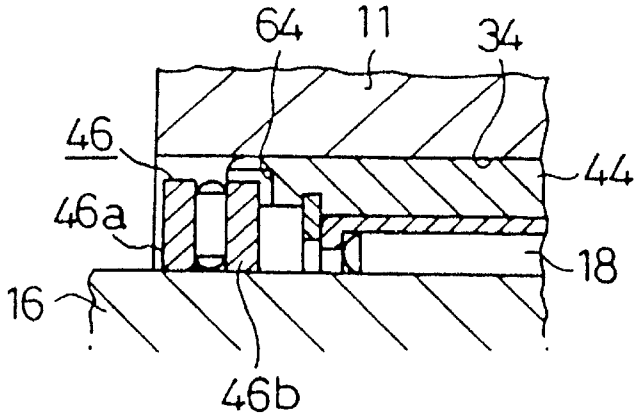
FIG. 5
FIG. 4
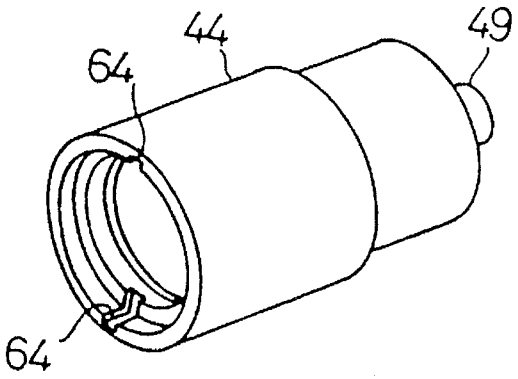

VARIABLE DISPLACEMENT COMPRESSOR

BACKGROUND OF THE INVENTION

1. Field of the Invention

The present invention relates to variable displacement compressors, and more particularly, to a variable displacement compressor for an air conditioner that alters its displacement according to the cooling load.

2. Description of the Related Art

Variable displacement compressors mounted on vehicles generally alter their displacement according to the temperature inside the vehicle to maintain the temperature of the vehicle interior at an appropriate value. Such a compressor is described in another of the applicants' patent applications filed with the United States Patent and Trademark Office (U.S. patent application Ser. No. 08/255,043) and the European Patent Office, which is published in European Patent Publication No. EP 0628722 A1. This prior art compressor has a housing with cylinder bores. A single-headed piston is reciprocally movable in each bore. A rotary shaft in the housing supports a swash plate, which is tiltable between a minimum inclined angle and a maximum inclined angle.

The displacement of the compressor corresponds with the inclined angle of the swash plate. When the swash plate is tilted at its maximum angle, the displacement of the compressor reaches its maximum. When the swash plate is tilted at its minimum angle, the compressor restricts discharge of compressed gas from the compressor. The inclined angle of the swash plate is adjusted by a pressure difference between the pressure in a crank chamber, which accommodates the swash plate, and the suction pressure. The pressure inside the crank chamber is thus altered to adjust the displacement of the compressor. To increase the pressure in the crank chamber, the pressure of a discharge pressure area, where compressed gas is discharged, is conveyed into the crank chamber through a pressurizing passage. To decrease the pressure in the crank chamber, the pressure of the crank chamber is released into a suction pressure area, where gas is drawn in, through a pressure releasing passage.

The compressor has a suction passage that introduces refrigerant gas from an external refrigerating circuit into the suction pressure area. A spool, which moves between a closing position and an opening position in correspondence with the inclined angle of the swash plate, is provided in the suction passage. When the swash plate is inclined at its minimum angle, the spool is moved to the closing position. This blocks the flow of refrigerant gas and prevents the gas from being drawn in. In this state, refrigerant gas circulates between the discharge pressure area, the crank chamber, and the suction pressure area through the pressurizing and pressure release passages and lubricates the interior of the compressor with oil mist suspended in the gas.

Loads in the axial and radial directions act on the rotary shaft. To cope with these loads, an angular contact bearing, which carries both axial and radial loads, is typically provided between the spool and the rotary shaft. In other words, a single bearing is employed to carry both axial and radial loads. This structure enables a reduction in the number of components and thus simplifies assembly.

However, it is required that the angular contact bearing have sufficient strength to carry the load acting in two directions on the rotary shaft. Thus, the size of the angular contact bearing is large. This results in a larger compressor.

Furthermore, it is preferable for the radial load of the rotary shaft to be supported at a position near the end of the shaft. However, since the angular contact bearing is located between the swash plate and the spool, the bearing is at a position separated from the end of the shaft. Accordingly, it is difficult to stably support the rotary shaft in the radial direction with the prior art structure. This may result in generation of vibration and noise during operation and cause a degradation in its performance.

In addition, refrigerant gas circulating between the crank chamber and the suction pressure area passes through the space between the swash plate and the spool in the above compressor. However, since the space defined between the swash plate and the spool is small, smooth circulation of the gas is impeded. This may cause insufficient lubrication of the angular bearing together with the other bearings. Insufficient lubrication will cause vibration and noise and reduce the life of the compressor.

SUMMARY OF THE INVENTION

A primary objective of the present invention is to provide a variable displacement compressor that enables its size to be more compact.

Another objective of the present invention is to provide a variable displacement compressor with superior usability.

A further objective of the present invention is to provide a variable displacement compressor in which smooth operation is ensured.

To achieve the above objects, a variable displacement compressor is provided. The compressor includes a swash plate supported on a drive shaft for integral rotation therewith. The swash plate is tiltable between a maximum inclined angle and a minimum inclined angle with respect to a plane perpendicular to the axis of the drive shaft and to a piston coupled to the swash plate. The inclined angle of the swash plate is changed in accordance with differences between the pressure in crank chamber and the pressure in the suction chamber so as to compress the gas and vary the displacement of the compressor. The compressor comprises a spool disposed adjacent to the swash plate on the drive shaft, and a first bearing disposed on the drive shaft between the swash plate and the spool. The first bearing is arranged to receive axial load generated by and acting on the rotating drive shaft. A second bearing is disposed on the drive shaft within the spool. The second bearing is arranged to receive radial load generated by and acting on the rotating drive shaft.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 4 is a perspective view of the spool illustrated in FIG. 1;

FIG. 5 is an enlarged and fragmentary cross-sectional view showing a portion of the compressor of FIG. 1;

DESCRIPTION OF THE PREFERRED EMBODIMENTS

Figure 1:
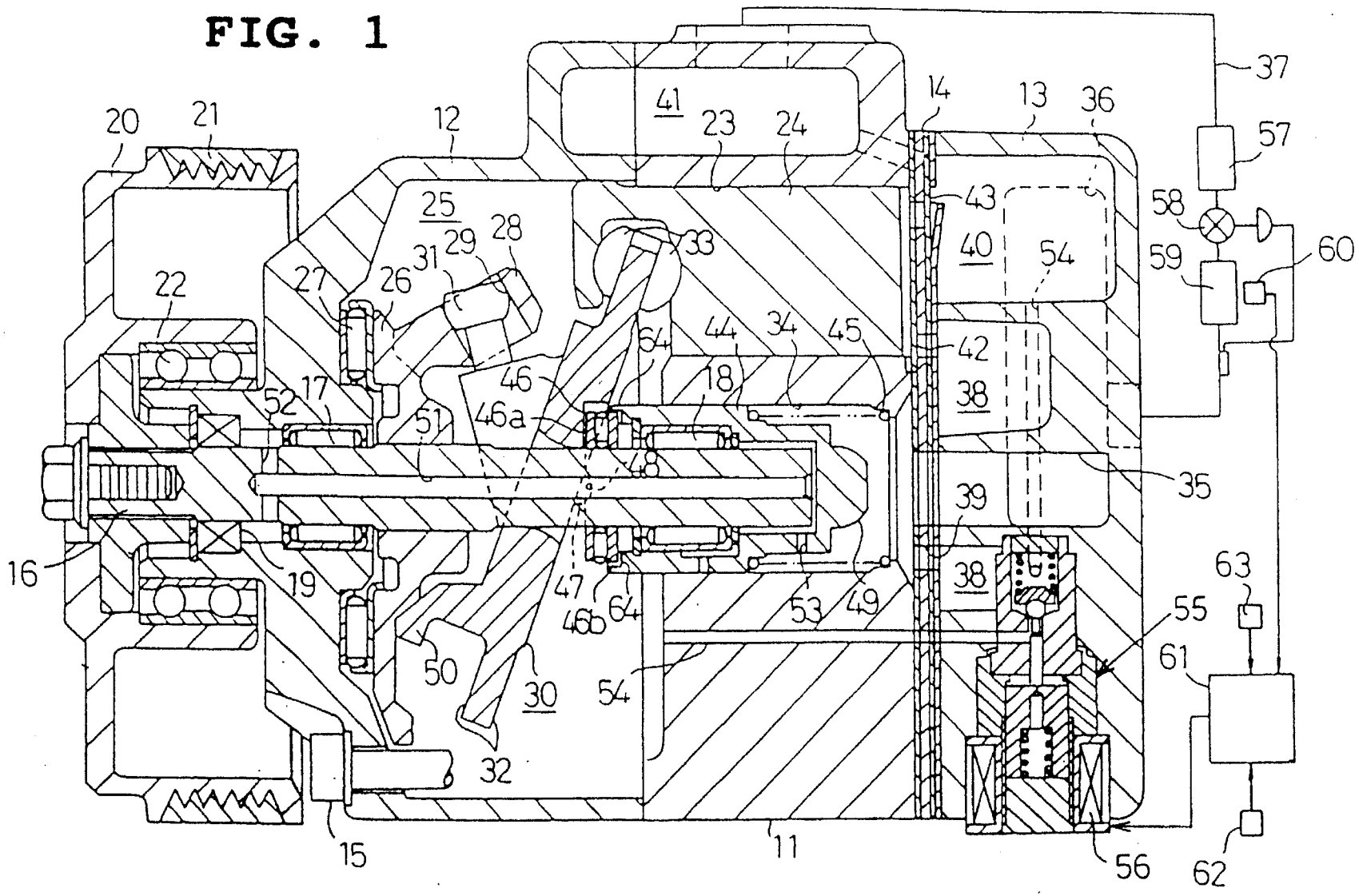
FIG. 1 is a cross-sectional side view showing a variable displacement compressor according to the present invention with its swash plate shown at the maximum inclined angle.

The present invention relates to a clutchless type variable displacement compressor. As shown in FIG. 1, a front housing 12 is secured to the front end of a cylinder block 11. A rear housing 13 is secured to the rear end of the block 11 with a valve assembly 14 provided in between. The cylinder block 11, the front housing 12, and the rear housing 13 constitute the compressor's housing. A plurality of bolts 15 are inserted through the front housing 12, the cylinder block 11, and the valve assembly 14 to be threaded into the rear housing 13. This fastens the front and rear housings 12, 13 to each end of the block 11.

A rotary shaft 16 is rotatably supported by two radial bearings 17, 18 in the center of the block 11 and the front housing 12. A lip seal 19 is provided between the front peripheral surface of the shaft 16 and the front housing 12. The seal 19 prevents pressure from escaping from a crank chamber 25 (described later).

A pulley 20 is secured to the front end of the shaft 16, which protrudes from the front housing 12 and is connected to a drive source such as an engine (not shown). By connecting the shaft 16 and the drive source, an electromagnetic clutch often used in conventional compressors is unnecessary. This prevents the impact caused by connection and disconnection of the clutch when starting or stopping the operation of the compressor.

An angular contact bearing 22 is provided between the pulley 20 and the front housing 12. The angular bearing 22 carries load acting on the pulley 20 in both axial and radial directions.

A plurality of cylinder bores 23 extend through the block 11. The axes of the bores 23 are parallel to the axis of the shaft 16 and are equally spaced. A single-headed piston 24 is fitted in each bore 23 for reciprocating motion.

A crank chamber 25 is defined inside the front housing 12 in front of the block 11. A lug plate 26 is secured to the shaft 16 inside the crank chamber 25 and rotates integrally with the shaft 16. The lug plate 26 abuts against the inner surface of the front housing 12 by way of a thrust bearing 27. The lug plate 26 includes an arm 28 that protrudes toward the block 11. A pair of guide holes 29 are formed at the distal end of the arm 28 extending in a direction that intersects with the shaft 16.

A substantially disk-shaped swash plate 30 is tiltably fitted on the shaft 16. The swash plate 30 includes a pair of connectors 31 with spherical ends projecting from its front side. Each connector 31 is rotatably and slidably connected within an associated guide hole 29. This hinge-like connection enables the angle of the swash plate 30 to be altered with respect to the lug plate 26.

The swash plate 30 has a sliding surface 32 defined on the periphery of its front and rear sides. The sliding surface 32 is connected to each piston 24 by a pair of hemispherical shoes 33. Rotation of the shaft 16 is transmitted to the swash plate 30 by the lug plate 26, the connectors 31, etc., and converted to rotation of the swash plate 30. When the swash plate 30 is rotated, their pistons 24 reciprocate inside their associated cylinder bores 23 with the same stroke as determined by the inclined angle of the swash plate 30.

A retaining chamber 34 extends through the center of the cylinder block 11. The axis of the retaining chamber 34 is aligned with the axis of the shaft 16. A suction passage 35 extending along the axis of the shaft 16 is formed in the rear housing 13 and adjacent to the valve assembly 14. The inner end of the suction passage 35 is connected to the retaining chamber 34. The outer end of the suction passage 35 is connected to an external refrigerating circuit 37 through a suction muffler 36. An annular suction chamber 38, which constitutes a suction pressure area, is defined at the center section of the rear housing 13. The suction chamber 38 is connected to the retaining chamber 34 through an opening 39 formed in the valve assembly 14. An annular discharge chamber 40, which constitutes a discharge pressure area, is defined at the outer section in the rear housing 13. The discharge chamber 40 is connected to the external refrigerating circuit 37 through a discharge muffler 41 located on the periphery of the block 11.

A suction valve mechanism 42 is provided in the valve plate assembly 14. The valve mechanism 42 enables refrigerant gas to be drawn into the compressing chambers defined in each bore 23 when the pistons 24 reciprocate inside the bores 23. In a similar manner, a discharge valve mechanism 43 is provided in the valve plate assembly 14. The valve mechanism 43 enables refrigerant gas, compressed in the compressing chambers of each bore 23, to be discharged into the discharge chamber 40 when the pistons 24 reciprocate inside the bores 23.

A spool 44 is slidably retained in the retaining chamber 34 aligned with the axis of the shaft 16. A coil spring 45 is provided between the spool 44 and the rear end of the retaining chamber 34. The spring 45 urges the spool 44 toward the swash plate 30. The rear radial bearing 18 is fit into the spool 44. The rear end of the shaft 16 is slidably supported inside the bearing 18. This structure enables load in the radial direction, which acts on the shaft 16 during its rotation, to be carried by the bearing 18.

Due to the functional requirements of a radial bearing, the bearing 18 employed in this embodiment is long in its axial direction and small in its radial direction. Thus, the space defined within the spool 44 to accommodate the bearing 18 is relatively small.

Figure 2:
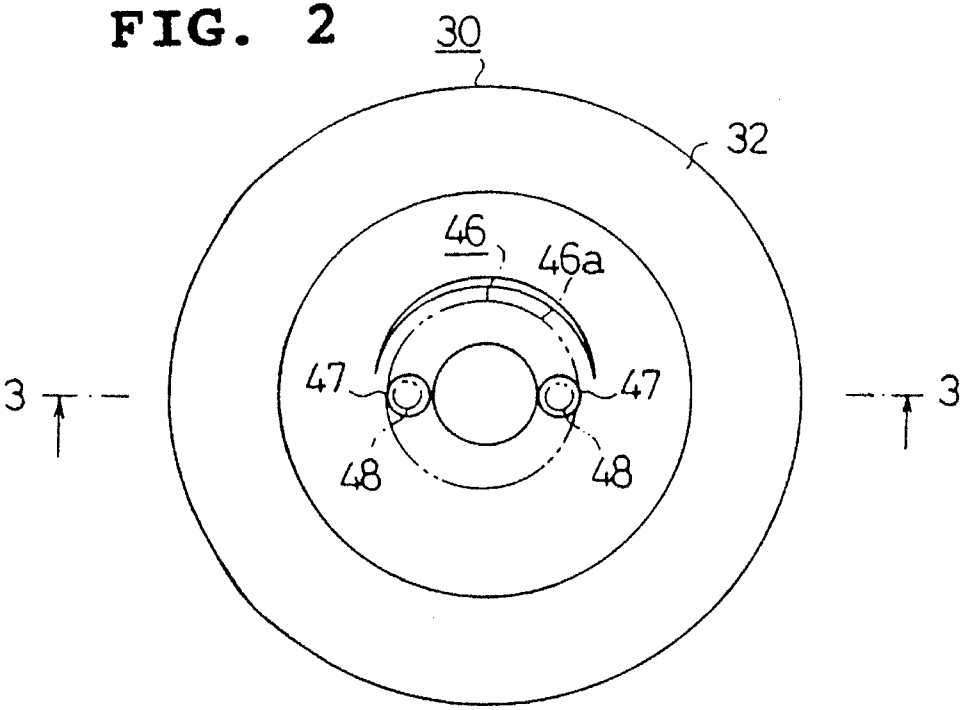
FIG. 2 is a top plan view showing the swash plate of the compressor illustrated in FIG. 1.
Figure 3:
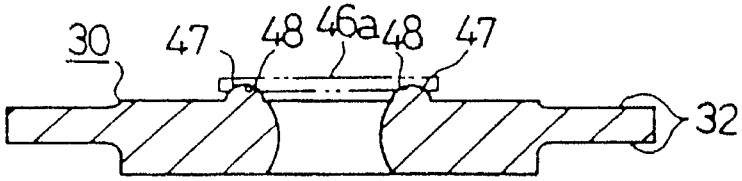
FIG. 3 is a cross-sectional view taken along line 3—3 shown in FIG. 2.

As shown in FIGS. 1 to 3, a thrust bearing 46 is fit onto the shaft 16 between the spool 44 and the swash plate 30. The swash plate 30 has a pair of projections 47, each with a round top, on its rear surface. The thrust bearing 46 has a pair of recesses 48, which correspond to the projections 47, on its front race **46*a*. The recesses 48 engage with the corresponding projections 47. Load in the axial direction, which acts on the spool 44 during tilting and rotation of the swash plate 30, is carried by the bearing 46. With the front race 46*a* of the bearing 46 and the swash plate 30 abutted against each other, engagement of the projections 47 and the recesses 48 prevents relative rotation between the swash plate 30 and the front race 46*a* of the bearing 46. This enables integral rotation of the swash plate 30 and the race 46*a* and thus minimizes abrasion between the race 46*a* and the swash plate 30**.

Figure 6:
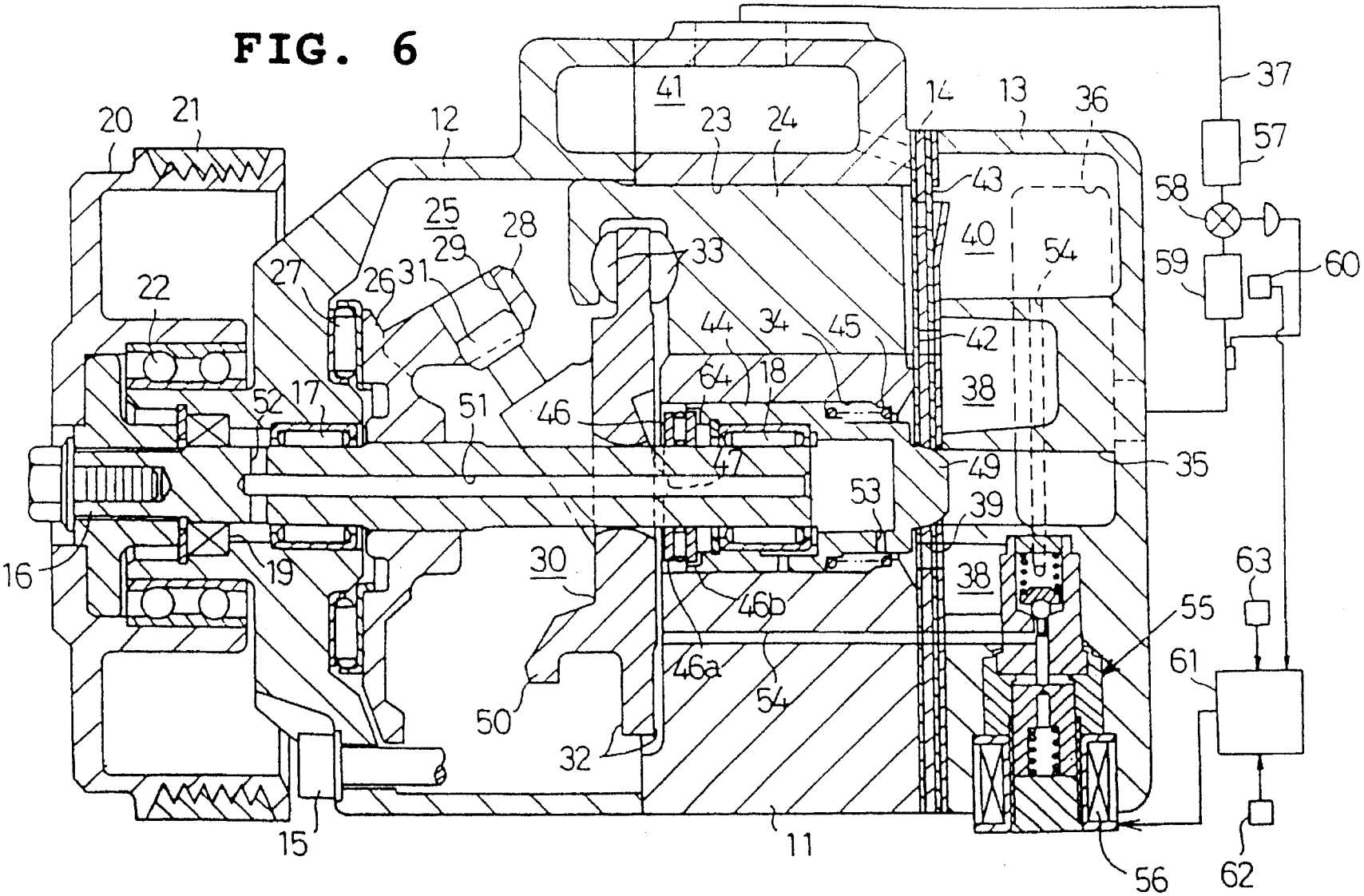
FIG. 6 is a cross-sectional view of the compressor shown in FIG. 1 with the swash plate at its minimum inclined angle.

A plug portion 49 projects from the rear end of the spool 44 towards the suction passage 35. The plug portion 49 has a substantially hemispheric outer surface. As shown in FIG. 6, when the swash plate 30 is tilted to its minimum inclined angle, the spool 44 is moved rearward against the urging force of the spring 45 to a closing position. At this position, the plug portion 49 is fitted into the suction passage 35. This blocks the flow of refrigerant gas from the external refrigerating circuit 37 to the suction chamber 38. Location of the spool 44 at the closing position restricts the swash plate 30 to the minimum inclined angle, which is slightly greater than zero degrees from perpendicular with respect to the shaft 16.

As shown in FIG. 1, when the swash plate 30 is tilted to its maximum inclined angle, the spool 44 is urged forward by the urging force of the spring 45 to an opening position. At this position, the plug portion 49 is separated from the suction passage 35. This allows the refrigerant gas from the external refrigerating circuit 37 to flow into the suction chamber 38 via the suction passage 35. In this state, rotation of the swash plate 30 causes the displacement of the compressor to reach its maximum. Abutment of projections 50 on the front surface of the swash plate 30 against the lug plate 26 restricts the swash plate 30 to its maximum inclined angle.

Shifting of the spool 44, in correspondence with the tilting of the swash plate, between the closing and opening positions, allows the plug portion 49 to gradually enter or move away from the suction passage 35. Thus, since the suction passage 35 is not suddenly opened or closed, a drastic increase or decrease in displacement of the compressor and a sudden change in the compressor's load torque within a short period of time is avoided.

As shown in FIG. 1, a pressure releasing passage 51 is defined in the shaft 16 along its axis. The front end of the releasing passage 51 is connected to the crank chamber 25 through a communicating hole 52. The rear end of the releasing passage 51 is connected to the interior of the spool 44. A pressure releasing hole 53 is formed through the rear peripheral wall of the spool 44. The interior of the spool 44 is communicated with the retaining chamber 34 through the releasing hole 53. The pressure inside the crank chamber 25 is released into the suction chamber 38 by way of the communicating hole 52, the pressure releasing passage 51, the interior of the spool 44, the pressure releasing hole 53, the retaining chamber 34, and the opening 39.

A pressurizing passage 54 is defined extending continuously through the rear housing 13, the valve assembly 14, and the block 11. The discharge chamber 40 is connected to the crank chamber 25 by the pressurizing passage 54. An electromagnetic valve 55 is provided midway of the pressurizing passage 54. For adjustment of the pressure inside the crank chamber 25, a solenoid 56 is deactivated. This opens the valve 55 and releases the pressure in the discharge chamber 40 into the crank chamber 25 through the pressurizing passage 54.

The external refrigerating circuit 37 includes a condenser 57, an expansion valve 58, and an evaporator 59. A temperature sensor 60 is arranged in the vicinity of the evaporator 59 to detect the temperature of the evaporator 59 and send a signal based on the detected value to a controller 61. The controller 61 is connected to a switch 62, which selectively activates and deactivates an air-conditioning system, and a rotation speed detector 63, which detects the rotation speed of the engine.

When the temperature detected by the temperature sensor 60 is equal to or lower than a predetermined value, the controller 61 deactivates the solenoid 56 and opens the valve 55. The predetermined value coincides with the temperature at which frost starts forming in the evaporator 59 when the temperature is lowered. The controller 61 deactivates the solenoid 56 and opens the valve 55 when the speed detector 63 detects the rotation speed exceeding a predetermined value. The controller 61 deactivates the solenoid 56 and opens the valve 55 when the switch 62 is turned off.

As shown in FIGS. 1, 4, and 5, a pair of lubricating grooves 64 are formed in the spool 64 at its inner front end. The grooves 64 correspond with the rear race **46*b* of the thrust bearing 46. As shown in FIG. 6, the grooves 64 enables lubrication of the thrust and radial bearings 46, 18 by allowing refrigerant gas within the crank chamber 25, regardless of the swash plate 30 being positioned at the minimum inclined angle with the spool 44 completely inserted in the retaining chamber 34, to pass through and flow sufficiently into the spool 44 by way of the bearings 46, 18**.

The operation of the above variable displacement compressor will now be described. When the switch 62 is turned on with the compressor in the state shown in FIG. 1, the solenoid 56 is activated to close the valve 55. This, in turn, closes the pressurizing passage 54. As a result, the highly pressurized refrigerant gas in the discharge chamber 40 is not conveyed to the crank chamber 25. Thus, refrigerant gas which flows into the suction chamber 38 via the pressure releasing passage 51 and the pressure releasing hole 53 comes solely from the crank chamber 25. This causes the pressure in the crank chamber 25 to approach the low pressure, or suction pressure, inside the suction chamber 38. In other words, the difference between the suction pressure and the crank chamber pressure becomes small. The small pressure difference tilts the swash plate 30 toward the maximum inclined angle. The suction pressure is altered in accordance with the cooling load. Hence, a change of cooling load, or alteration of the difference between the pressure inside the crank chamber 25 and the suction pressure, changes the inclined angle of the swash plate 30 and adjusts the reciprocating stroke of the pistons 24. This, in turn, adjusts the displacement of the compressor.

As the large amount of compressor displacement lowers the cooling load, the temperature of the evaporator 59 gradually becomes lower. When the temperature of the evaporator 59 becomes equal to or lower than a predetermined value, at which frost begins to form, the controller 61 deactivates the solenoid 56 and opens the valve 55 in response to a signal from the temperature sensor 60. The controller 61 also deactivates the solenoid 56 and opens the valve 55 when the switch 62 is turned off.

Opening of the valve 55 allows the highly pressurized refrigerant gas in the discharge chamber 40 to be conveyed into the crank chamber 40. This raises the pressure inside the crank chamber 25 and increases the difference between the suction pressure and the crank chamber pressure. Accordingly, the swash plate 30 is readily tilted from its maximum inclined angle to its minimum inclined angle. This reduces the displacement of the compressor.

As the inclined angle of the swash plate 30 becomes smaller, a rearward driving force is applied to the spool 44 through the thrust bearing 46. This moves the spool 44 against the urging force of the spring 45 from the forward opening position to the rearward closing position. As shown in FIG. 6, when the swash plate 30 reaches its minimum inclined angle with the spool 44 at its rearward closing position, the plug portion 49 of the spool 44 is fitted into and engaged with the suction passage 35. This closes the suction passage 35 and stops the flow of refrigerant gas from the external refrigerating circuit 37 to the suction chamber 38.

The minimum inclined angle of the swash plate 30 is slightly greater than zero degrees. Thus, discharge of refrigerant gas from the compressing chamber, defined in each bore 23, to the discharge chamber 40 is continued. In this state, the displacement of the compressor is minimum. The refrigerant gas discharged into the discharge chamber 40 flows into the crank chamber 25 through the pressurizing passage 54. The gas then flows through the pressure releasing passage 51, the pressure releasing hole 53, and the suction chamber 38 to be drawn into the compressing chamber defined in each bore 23 once again. In other words, when the swash plate 30 is at its minimum inclined angle, the refrigerant gas circulates inside the compressor between the bores 23, the discharge chamber 40, the crank chamber 25, and the suction chamber 38. The circulation of the refrigerant gas lubricates the interior of the compressor with the oil mist suspended in the gas.

By directly connecting the compressor to the engine without using an electromagnetic clutch, the compressor continues operation even when cooling is not necessary. When the compressor is not required to perform cooling, cooling load or manipulation of the switch 62 causes the displacement of the compressor to become minimum with only a small amount of refrigerant gas circulating inside the compressor. This prevents generation of noise and vibration and occurrence of burn-outs.

When the compressor is operated with the switch 62 turned on and the swash plate 30 at the minimum inclined angle as shown in FIG. 6, the cooling load increases and gradually raises the temperature of the evaporator 59. The controller 61 activates the solenoid 56 and closes the valve 55 when the temperature of the evaporator 59 exceeds a predetermined value. This closes the pressurizing passage 54 and stops the highly pressurized refrigerant gas in the discharge chamber 40 from flowing into the crank chamber 25. As a result, the highly pressurized refrigerant gas in the discharge chamber 40 is not conveyed to the crank chamber 25. Thus, the refrigerant gas that flows into the suction chamber 38 via the pressure releasing passage 51 and the pressure releasing hole 53 comes solely from the crank chamber 25. This causes the pressure in the crank chamber 25 to gradually fall and tilts the swash plate 30 toward its maximum inclined angle.

As the inclined angle of the swash plate 30 becomes greater, the spool 44 is moved from its rearward closing position toward its forward opening position by the urging force of the spring 45. When the swash plate 30 reaches the maximum inclined angle, as shown in FIG. 1, the spool 44 is at the forward opening position. The plug portion 49 is separated from the suction passage 35 in this state. Thus, the compressor is operated with the opened suction passage 35 allowing the flow of the refrigerant gas from the external refrigerating circuit 37 to the suction chamber 38.

As described above, load in the axial direction acts on the spool 44 when the swash plate 30 is tilted between the maximum and minimum inclined angle and when the swash plate 30 is rotated by the shaft 16. However, the axial load is carried by the thrust bearing 46 provided between the spool 44 and the swash plate 30. Load in the radial direction is carried by radial bearings 17, 18. Hence, the bearing 46 does not require the durability necessary to carry both axial and radial loads. This prolongs the life of the bearing 46. This also allows the radial dimension of the bearing 46 to be minimized and thus results in a smaller compressor.

In addition, since the thrust bearing 46 carries the axial load acting between the swash plate 30 and the spool 44, the radial bearing 18 may be arranged at a position on the shaft 16 that is rearward from the thrust bearing 46. Thus, the rotary shaft 16 is supported at positions near both of its ends with the radial bearing 18 supporting one of the ends. This contributes to stable rotation of the shaft 16 and reduces vibration and noise.

The projections 47, which have round tops, are provided on the rear side of the swash plate 30. The projections 47 ensure abutment of the swash plate 30 against the front race **46*a* of the thrust bearing 46 regardless of the angle of the swash plate 30. This allows the tilting of the swash plate 30 to accurately shift the spool 44 between the opening and closing positions with the bearing 46 located between the swash plate 30 and the spool 44. The round tops of the projections 47 enable the position of abutment with the front race 46*a* of the thrust bearing 46 to be smoothly displaced when the inclined angle of the swash plate 30** is altered.

In this compressor, the pair of lubricating grooves 64 is formed on the front inner end of the spool 44 in correspondence with the rear race 46b of the thrust bearing 46. Thus, even when the swash plate 30 is at the minimum inclined angle, as shown in FIG. 6, and minimizes the amount of gas circulating inside the compressor, a sufficient amount of refrigerant gas in the crank chamber 25 flows into the spool 44 through the grooves 64, the thrust bearing 46, and the rear radial bearing 18.

More specifically, when the swash plate 30 is at the minimum inclined angle, the refrigerant gas in the crank chamber 25 flows into the suction chamber 38 via the communicating hole 52, the pressure releasing passage 51, the inside of the spool 44, the pressure releasing hole 53, the retaining chamber 34 and the opening 39. This enables the front radial bearing 17 provided at the front end of the shaft 16 to be efficiently lubricated with the oil mist suspended in the refrigerant gas. If the thrust bearing 46 and the rear radial bearing 18 were arranged near each other at the rear end of the shaft 16, it would generally impede the flow of refrigerant gas passing therethrough into the spool 44. However, the compressor of this embodiment enables the refrigerant gas in the crank chamber 25 to pass through the grooves 64 without interference and flow into the spool 44. Therefore, the oil mist suspended in the refrigerant gas is efficiently supplied to the thrust bearing 46 and the radial bearing 18. This prevents the bearings 46, 18 from becoming starved of lubricant.

Although only one embodiment of the present invention has been described so far, it should be apparent to those skilled in the art that the present invention may be embodied in many other specific forms without departing from the spirit or scope of the invention. Particularly, it should be understood that the present invention may also be modified as described below.

Figure 8:
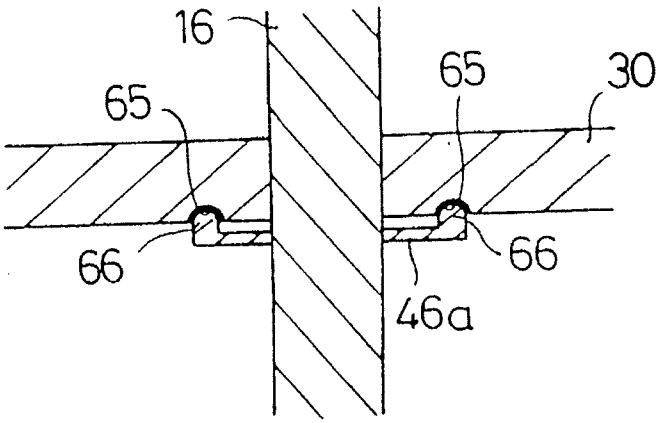
FIG. 8 is a fragmentary cross-sectional view taken along line 8—8 shown in FIG. 7.
Figure 7:
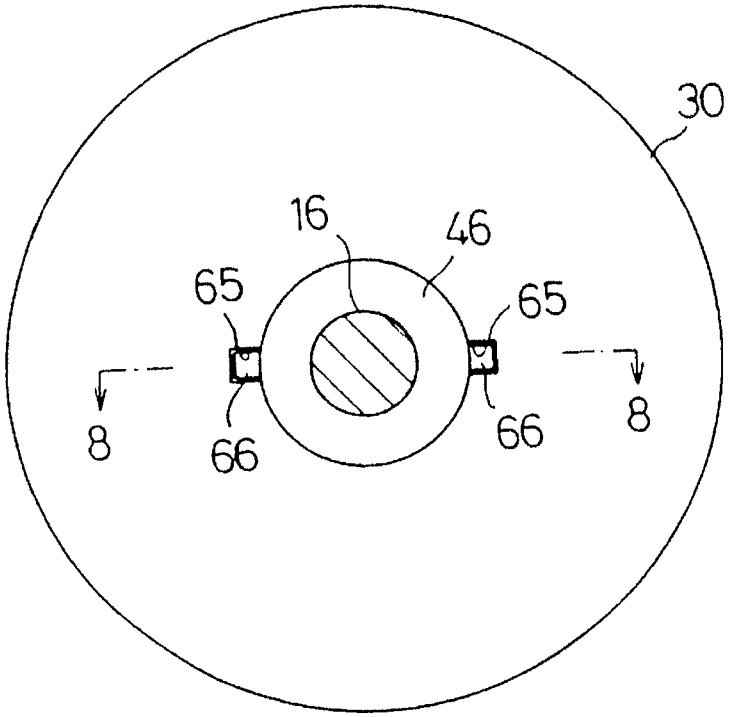
FIG. 7 is a cross-sectional view showing a swash plate according to a modification of the present invention.

(a) As shown in FIGS. 7 and 8, a pair of projections 66 may be formed through a bending process on the front race **46*a* of the thrust bearing 46. In this case, a pair of corresponding holes 66 that engage with the swash plate 30 are also formed in the swash plate 30**.

(b) Contrary to the above modification shown in FIGS. 7 and 8, projections may be provided on the swash plate 30 with corresponding holes formed in the front race **46*a* of the thrust bearing 46**.

(c) A separate connecting device may be provided between the swash plate 30 and the front race **46*a* of the thrust bearing 46**.

(d) The lubricating grooves 64 may be provided in the rear race **46*b* in a manner corresponding to the inner front end of the spool 44**.

Therefore, the present examples and embodiments are to be considered as illustrative and not restrictive and the invention is not to be limited to the details given herein, but may be modified within the scope of the appended claims.

What is claimed is:

1. A variable displacement compressor including a swash plate supported within a crank chamber of a housing on a drive shaft for integral rotation with the drive shaft, the swash plate being tiltable between a maximum inclined angle and a minimum inclined angle with respect to a plane perpendicular to the longitudinal axis of the drive shaft, and at least one piston coupled to the swash plate and disposed in a bore within the housing, wherein rotation of the drive shaft is converted by the swash plate into reciprocating movement of the piston such that gas is drawn from a suction chamber through an inlet valve into the bore during a suction stroke and compressed gas is discharged from the bore through a discharge valve into a discharge chamber during a discharge stroke, and wherein the inclined angle of the swash plate is changed in accordance with the difference between the pressure in the crank chamber and the pressure in the suction chamber to vary the displacement of the compressor, said compressor comprising:

a spool disposed adjacent to the swash plate on the drive shaft;

a first bearing disposed on the drive shaft between the swash plate and said spool, said first bearing being arranged to receive axial load generated by and acting on the rotating drive shaft; and a second bearing disposed on the drive shaft said spool, said second bearing being arranged to receive radial load generated by and acting on the rotating drive shaft.

2. The compressor as set forth in claim 1 further comprising:

said spool having an open end and closed end, said open end facing the swash plate and said closed end facing away from the swash plate; and one of said spool open end and said first bearing having a notch to provide a passage for the gas.

3. The compressor as set forth in claim 2 further comprising a member biasing the spool towards the swash plate.

4. The compressor as set forth in claim 1 further comprising:

a passage way for introducing the gas to the suction chamber; and said spool being arranged to close the passage way when the swash plate is kept at the minimum inclined angle and open the passage way when the swash plate moves from the minimum angle towards the maximum inclined angle.

5. The compressor as set forth in claim 4, wherein said minimum inclined angle of the swash plate is slightly offset from the plane perpendicular to the axis of the drive shaft, and whereby the gas is circulated inside the compressor when the swash plate is kept at the minimum inclined angle.

6. The compressor as set forth in claim 5 further comprising:

the drive shaft having a first end and a second end, said second bearing supporting said first end of the drive shaft; and a third bearing supporting said second end of the drive shaft to receive radial load generated by and acting on the rotating drive shaft.

7. The compressor as set forth in claim 6 further comprising:

a first engaging means provided on the swash plate opposing the first bearing, said first engaging means including one of a projection and a recess; and a second engaging means provided on the first bearing opposing the swash plate, said second engaging means including the other one of said projection and said recess and engaging the first engaging means.

8. The compressor as set forth in claim 7, wherein said projection has a substantially hemispherical end.

9. A variable displacement compressor including a swash plate supported within a crank chamber of a housing on a drive shaft for integral rotation with the drive shaft, the swash plate being tiltable between a maximum inclined angle and a minimum inclined angle with respect to a plane perpendicular to the longitudinal axis of the drive shaft, and a piston coupled to the swash plate and disposed in a cylinder bore within the housing, wherein rotation of the drive shaft is converted by the swash plate into reciprocating movement of the piston such that gas is drawn from a suction chamber through an inlet valve into the cylinder bore during a suction stroke and compressed gas is discharged from the cylinder bore through a discharge valve into a discharge chamber during a discharge stroke, and wherein the inclined angle of the swash plate is changed in accordance with the difference between the pressure in the crank chamber and the pressure in the suction chamber to move the piston in the cylinder bore with a stroke determined by the inclined angle of the swash plate to vary the displacement of the compressor, said compressor comprising:

a spool disposed adjacent to the swash plate on the drive shaft;

a first bearing disposed on the drive shaft between the swash plate and the spool, said first bearing being arranged to receive axial load generated by and acting on the rotating drive shaft;

a second bearing disposed on the drive shaft within the spool, said second bearing being arranged to receive radial load generated by and acting on the rotating drive shaft;

said spool having an open end and a closed end, said open end facing the swash plate and said closed end facing away from the swash plate;

said gas containing lubricant oil mist; and one of said spool open end and said first bearing having a notch to provide a passage for the gas.

10. The compressor as set forth in claim 9 further comprising a member biasing said spool toward the swash plate.

11. The compressor as set forth in claim 10 further comprising:

a passage way for introducing the gas to the suction chamber; and said spool being arranged to close the passage way when the swash plate is kept at the minimum inclined angle and open the passage way when the swash plate moves from the minimum angle towards the maximum inclined angle.

12. The compressor as set forth in claim 11, wherein said minimum inclined angle of the swash plate is slightly offset from the plane perpendicular to said axis of the drive shaft, and whereby the gas is circulated inside the compressor when the swash plate is kept at the minimum inclined angle.

13. The compressor as set forth in claim 12 further comprising:

the drive shaft having a first end and a second end, said second bearing supporting said first end of the drive shaft; and a third bearing supporting said second end of the drive shaft to receive radial load generated by and acting on the rotating drive shaft.

14. The compressor as set forth in claim 13 further comprising:

a first engaging means provided on the swash plate opposing the first bearing, said first engaging means including one of a projection and a recess; and a second engaging means provided on the first bearing opposing the swash plate, said second engaging means including the other one of said projection and said recess and engaging the first engaging means.

15. The compressor as set forth in claim 14, wherein said projection has a substantially hemispherical end.

16. A variable displacement compressor including a swash plate supported within a crank chamber of a housing on a drive shaft for integral rotation with the draft shaft, the swash plate being tiltable between a maximum inclined angle and a minimum inclined angle with respect to a plane perpendicular to longitudinal axis of the drive shaft, and at least one piston coupled to the swash plate and disposed in a cylinder bore within the housing, wherein rotation of the drive shaft is converted by the swash plate into reciprocating movement of the piston such that gas is drawn from a suction chamber through an inlet valve into the cylinder bore during a suction stroke and compressed gas is discharged from the cylinder bore through a discharge valve into a discharge chamber during a discharge stroke, and wherein the inclined angle of the swash plate is changed in accordance with the difference between the pressure in the crank chamber and the pressure in the suction chamber to move the piston in the cylinder bore with a stroke determined by the inclined angle of the swash plate to vary the displacement of the compressor, said compressor comprising:

a spool disposed adjacent to the swash plate on the drive shaft;

a member biasing the spool toward the swash plate;

a passageway for introducing the gas from the crank chamber to the suction chamber;

said spool being arranged to close the passageway when the swash plate is kept at the minimum inclined angle and open the passageway when the swash plate moves from the minimum angle toward the maximum inclined angle;

said spool having an open end and a closed end, said open end facing the swash plate and said closed end facing away from the swash plate;

said gas containing lubricant oil mist; and one of said spool open end and said first bearing having a notch to provide a passage for the gas.

* * * * *

UNITED STATES PATENT AND TRADEMARK OFFICE

CERTIFICATE OF CORRECTION

PATENT NO. : 5,616,008

DATED : April 1, 1997

INVENTOR(S) : YOKONO et al.

It is certified that error appears in the above-indentified patent and that said Letters Patent is hereby corrected as shown below:

Column 2, line 37, after "in" (first occurrence) insert --the--.

Column 11, line 18, after "to" insert --the--.

Signed and Sealed this

Ninth Day of December, 1997

*Attest:*

*Attesting Officer*

BRUCE LEHMAN

*Commissioner of Patents and Trademarks*